United States Patent [19]

Sooch

[11] Patent Number: 4,550,284

[45] Date of Patent: Oct. 29, 1985

[54] MOS CASCODE CURRENT MIRROR

[75] Inventor: Navdeep S. Sooch, Reading, Pa.

[73] Assignee: AT&T Bell Laboratories, Murray Hill, N.J.

[21] Appl. No.: 610,881

[22] Filed: May 16, 1984

[51] Int. Cl.[4] ..... G05F 3/08

[52] U.S. Cl. ..... 323/315; 330/288

[58] Field of Search ..... 323/312, 315; 330/288; 307/304, 297

[56] References Cited

U.S. PATENT DOCUMENTS

| | | | |
|---|---|---|---|
| 3,852,679 | 12/1974 | Schade, Jr. | 330/257 |
| 3,887,879 | 6/1974 | Radovsky | 330/257 |
| 4,281,261 | 7/1981 | Adam | 307/270 |
| 4,297,646 | 10/1981 | LoCascio et al. | 330/288 |
| 4,327,321 | 4/1982 | Suzuki et al. | 323/315 |
| 4,412,186 | 10/1983 | Nagano | 330/288 |
| 4,471,292 | 9/1984 | Schneck et al. | 323/315 |
| 4,477,782 | 10/1984 | Swanson | 330/288 |

*Primary Examiner*—William H. Beha, Jr.
*Attorney, Agent, or Firm*—Wendy W. Koba

[57] ABSTRACT

An MOS current mirror is disclosed which comprises only two circuit branches and requires only a single reference current. The input circuit branch includes at least four MOS transistors (40, 42, 44, 46) connected in series and the output circuit branch includes at least two MOS transistors (48, 50) interconnected with selected transistors of the input circuit branch. Mirroring of the input current ($I_{REF}$) is accomplished by providing a transistor (46, 50) in each circuit branch with identical operating characteristics ($V_{DS}$, $V_{GS}$). High output impedance is achieved in accordance with the present invention by adjusting the channel constant (Z/L) of another transistor (42) in the input circuit branch to be one-third the value of the channel constant associated with each of the remaining transistors.

5 Claims, 4 Drawing Figures

MOS CASCODE CURRENT MIRROR

BACKGROUND OF THE INVENTION

1. Field of the Invention

The present invention relates to an MOS current mirror and, more particularly, to an MOS cascode current mirror arrangement which requires only a single reference current while providing a large output impedance.

2. Description of the Prior Art

Current mirror circuits are well known in the art and have found uses in a variety of applications. Generally speaking, a current mirror circuit comprises a pair of transistors where an input reference current source is connected to drive one of the transistors. The pair of transistors are connected together in a manner whereby the reference current is substantially reproduced, or mirrored, at the output of the second transistor. In most cases, the critical factor in designing a current mirror circuit is providing optimum matching between the reference and output currents. U.S. Pat. No. 4,297,646 issued to LoCascio et al on Oct. 27, 1981 relates to a current mirror circuit, comprising bipolar transistors, with improved current matching provided by utilizing a single, split collector lateral bipolar transistor.

Current mirrors can also be formed using MOS devices, where one such arrangement is disclosed in U.S. Pat. No. 4,327,321 issued to H. Suzuki et al on Apr. 27, 1982. The Suzuki et al circuit also includes a resistor in the input rail between a P-channel MOSFET and an N-channel MOSFET to minimize the output current dependency on variations in the power supply. In MOS technology, small channel length devices are increasingly in demand. In relation to current mirror circuits, the decrease in channel length results in the decrease of the output impedance of the current mirror. Cascoding techniques become necessary, therefore, to increase the output impedance.

The advantages of cascoding transistors to form a stable current mirror are further exemplified in U.S. Pat. No. 4,412,186 issued to K. Nagano on Oct. 25, 1983. Like the LoCascio arrangement, Nagano discloses a current mirror circuit comprising bipolar transistors. In the Nagano arrangement, however, the circuit includes two stages, each having three transistors of one conductivity type and a fourth of the opposite conductivity type. When the four transistors are matched, the collector-to-emitter voltages, $V_{CE}$, of the third and fourth transistors are equivalent to their base-to-emitter voltages, $V_{BE}$.

These and other prior art cascode current mirror arrangements have not been widely used since they often exhibit one or more of the following problems; insufficient maximum voltage swing, excessive power consumption, insufficient output impedance, and inability to incorporate into integrated circuit designs.

SUMMARY OF THE INVENTION

The problems associated with prior art current mirrors are addressed by the present invention which relates to an MOS current mirror and, more particularly, to an MOS cascode current mirror arrangement which requires only a single reference current while providing a large output impedance.

It is an aspect of the present invention to provide current mirroring at a high output impedance with an arrangement of only six MOS transistors which requires only moderate power consumption, and can easily be incorporated into integrated circuits.

Another aspect of the present invention is to provide an MOS current mirror which can operate close to the circuit supply rails, thus providing a maximum output voltage swing.

A further aspect of this invention relates to maintaining an output impedance of at least $g_m/g_o^2$ while requiring only a single reference current source.

Other and further aspects of the present invention will become apparent during the course of the following discussion and by reference to the accompanying drawings.

BRIEF DESCRIPTION OF THE DRAWINGS

Referring now to the drawings.

DETAILED DESCRIPTION

Figure 1:
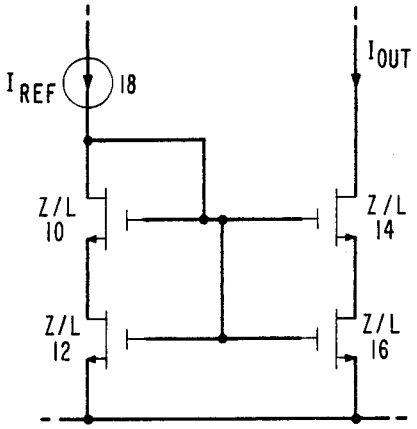
FIG. 1 (PRIOR ART)
FIG. 1 illustrates a basic prior art MOS cascode current mirror.

A conventional prior art cascode current mirror, formed with MOS devices, is illustrated in FIG. 1. As shown, an input circuit branch comprises an MOS transistor 10 connected in series with an MOS transistor 12 and an output circuit branch comprises an MOS transistor 14 connected in series with an MOS transistor 16. The gates of transistors 10–16 are connected together as shown in FIG. 1. A reference current 18, denoted $I_{REF}$, is applied to the drain of transistor 10 and is subsequently reproduced, or mirrored, as the output current, $I_{OUT}$, at the drain of transistor 14. Assuming that transistor 10–16 are well-matched, that is, they all have the same width-to-length channel ratio Z/L and are all connected to the same substrate, transistors 10 and 14 wil exhibit the same gate-to-source voltage, and similarly, transistors 12 and 16 will exhibit the same gate-to-source voltage. Therefore, since the current flowing through transistors 14 and 16 must match the current flowing through transistors 10 and 12, $I_{OUT}$ will be equal to, or mirror, the reference current $I_{REF}$. The current mirror illustrated in FIG. 1, however, has a relatively low output impedance since transistor 16 will operate in its resistive region instead of its saturated region, thus lowering the impedance seen by the source of transistor 14.

Figure 2:
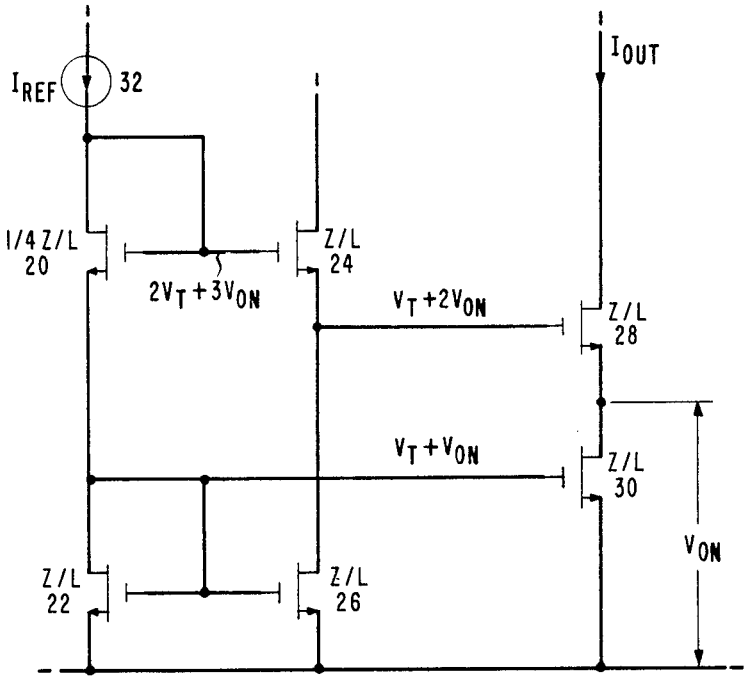
FIG. 2 (PRIOR ART)
FIG. 2 illustrates an improved prior art MOS cascode current mirror which comprises three separate circuit branches.

An alternative prior art arrangement, referred to as the Gray-Meyer cascode, which exhibits a relatively larger output impedance, is illustrated in FIG. 2. As shown, an additional circuit branch is included in this arrangement. In the Gray-Meyer cascode, a pair of MOS transistors 20 and 22 form the input circuit branch and are connected in series where the gate of transistor 20 is connected to the drain of transistor 20 and similarly, the gate of transistor 22 is connected to the drain of transistor 22. The next circuit branch contains a serially connected pair of MOS transistors 24 and 26, where as shown in FIG. 2, the gate of transistor 24 is connected to the gate of transistor 20 and the gate of transistor 26 is connected to the gate of transistor 22. The remaining circuit branch, the output branch, includes a pair of MOS transistors 28 and 30 also connected in series. In particular, the gate of transistor 28 is connected to the source of transistor 24 and the gate of transistor 30 is connected to the gates of transistors 22 and 26. A reference current 32, denoted $I_{REF}$, is applied to the drain of transistor 20 and is subsequently reproduced, or mirrored, at the drain of transistor 28. To provide the higher output impedance, transistor 30 is biased on the edge of saturation, with its drain one threshold voltage, denoted $V_T$, more negative than its gate voltage, denoted $V_T+V_{ON}$, where $V_{ON}$ is defined as the turn-on voltage of the device. This biasing is provided by transistors 24 and 26, which generate the voltage $V_T+2V_{ON}$ at the gate of transistor 28. Transistor 20 is designed to comprise a channel width-to-length ratio one-fourth that of the remaining transistors to compensate for the addition of transistors 24 and 26. The Gray-Meyer cascode does provide a high output impedance, but at the cost of a large power consumption, where the presence of the additional circuit branch is responsible for the increased power consumption. Further, the current $I_{REF}$ will never be duplicated accurately in the middle circuit branch since the drain-to-source voltages of transistors 22 and 24 are inherently different.

Figure 3:
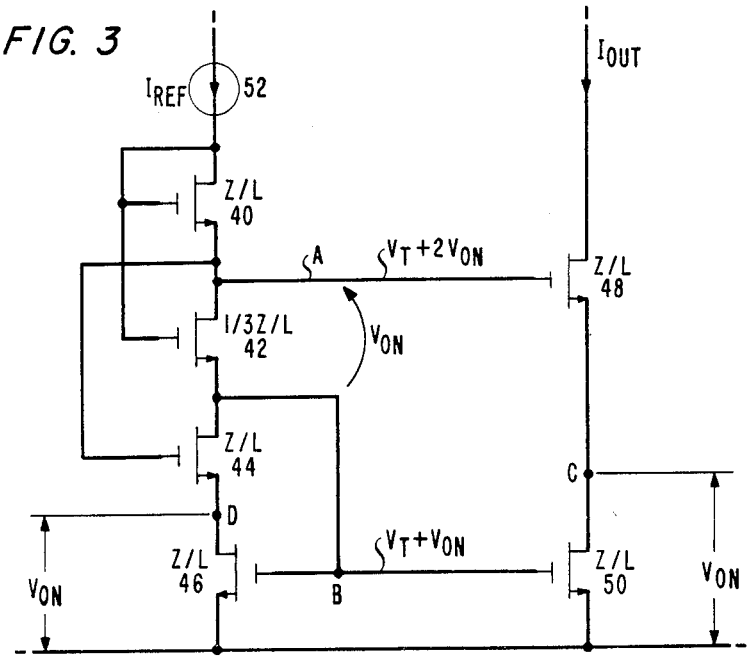
FIG. 3 illustrates an MOS current mirror formed in accordance with the present invention.

An MOS cascode current mirror which exhibits a large output impedance and is formed in accordance with the present invention is illustrated in FIG. 3. The arrangement shown, similar to the previous prior art circuits, includes N-channel MOS devices. However, it is to be understood that a current mirror formed in accordance with the present invention could also be formed from P-channel devices and the choice of N-channel devices in this instance is solely for the purpose of illustrating an exemplary embodiment of the invention.

As shown in FIG. 3, a current mirror of the present invention comprises only two circuit branches, a first branch responsive to the input reference current and a second branch to replicate this current to provide the mirrored output current. In particular, the input branch comprises a series connection of four MOS transistors 40, 42, 44, and 46, and an input reference current 52, denoted $I_{REF}$. As illustrated in FIG. 3, the gate of transistor 40 is connected to its drain and also to the gate of transistor 42. The gate of transistor 44 is connected to the source of transistor 40 and similarly, the gate of transistor 46 is connected to the source of transistor 42. The output circuit branch of the present current mirror comprises a pair of serially connected MOS transistors 48 and 50. As shown in FIG. 3, the gate of transistor 48 is connected to the source of transistor 40 and the gate of transistor 44, where this connection is defined as voltage node A, and the gate of transistor 50 is connected to the gate of transistor 46, where this connection is defined as voltage node B.

In accordance with the present invention, reference current 52, is coupled to the drain of transistor 40 and is subsequently reproduced as $I_{OUT}$ along the output branch, as explained below in detail. It is to be noted that transistor 42 is formed to comprise a channel width-to-length ratio, Z/L, one-third that of the remaining transistors. The purpose of this size difference is critical to the performance of the present invention and will later be discussed in detail.

The basic premise of the present invention is to provide a current mirror with a large output impedance, where this results from creating a voltage at node A equal to $V_T+2V_{ON}$ and a voltage at node B equal to $V_T$ and $V_{ON}$. Following this premise, the voltage at node C, defined as the drain-to-source voltage ($V_{DS}$) of transistor 50, will be equal to $V_{ON}$, since a $V_T+V_{ON}$ voltage drop will occur between the gate and source of transistor 48. Similarly, the voltage at node D, defined as $V_{DS}$ of transistor 46, will also be equal to $V_{ON}$, since a $V_T+V_{ON}$ voltage drop will occur between the gate and source of transistor 44. In accordance with the present invention, the gates of transistors 46 and 50 are connected together and are activated by the same gate to source voltage, $V_{GS}$, of $V_T+V_{ON}$. Since transistors 46 and 50, as stated above, have the same $V_{DS}$, which is equal to $V_{ON}$, the same current will, be definition, flow through each device. Therefore, $I_{OUT}$ will be identical to $I_{REF}$, that is, the output branch will mirror the current flowing through the input branch. Since the voltage at node A is forced to be $V_T+2V_{ON}$, the output circuit branch will exhibit a large output impedance.

Providing the required voltages at nodes A and B is accomplished using the process explained below. If all of the transistors illustrated in FIG. 3 are source-substrate connected, the threshold voltage, $V_T$, of each will be the same by definition. Providing a $V_{DS}$ of transistor 43 equal to $V_{ON}$ is accomplished by operating transistor 42 in its resistive region, where connecting the gates of transistors 40 and 42 forces transistor 42 to remain in its resistive region. Determining the necessary Z/L for transistor 42 is provided by the following calculations, where the current flowing through transistor 40 is assumed to be equal to the current flowing through transistor 42, and $V_{ON}$ is defined as the turn-on voltage of transistor 40. Standard I-V relations for MOS devices results in $$\frac{\mu}{2} C_o(Z/L)_1[2(V_{GS1} - V_T)V_{DS1} - V_{DS1}^2] = \frac{\mu}{2} C_o(Z/L)_2[V_{GS2} - V_T]^2, \quad (1)$$

where $(Z/L)_1$ is the channel constant of transistor 42, $V_{GS1}$ is the gate-to-source voltage of transistor 42, $V_{DS1}$ is the drain-to-source voltage of transistor 42, $(Z/L)_2$ is the channel constant of transistor 40, and $V_{GS2}$ is the gate-to-source voltage of transistor 40. If $$V_{GS1} - V_T = 2V_{ON}, \text{ and} \quad (2)$$

$$V_{GS2} - V_T = V_{ON}, \quad (3)$$

as seen by reference to FIG. 3, then $$V_{DS1} = V_{GS1} - V_{GS2} = V_{ON}. \quad (4)$$

Substituting equations (2)–(4) into equation (1), and simplifying, $$(Z/L)_1[2(2V_{ON})V_{ON} - V_{ON}^2] = (Z/L)_2[V_{ON}]^2. \quad (5)$$

Further simplification yields $$(Z/L)_1[3V_{ON}^2] = (Z/L)_2[V_{ON}^2], \text{ or} \quad (6)$$

$$(Z/L)_1 = \tfrac{1}{3}(Z/L)_2. \quad (7)$$

Therefore, in accordance with equation (7) if all of the transistors are source-substrate connected and transistor 42 comprises a channel constant, Z/L, one-third that of transistor 40, the voltages necessary at nodes A and B to provide a high output impedance will be generated. If Z/L of transistor 42 is formed to be less than one-third the Z/L of transistor 40, the voltage at node A will increase, thus insuring that transistor 50 operates well into its saturation region, providing an even greater output impedance. Additionally, if all of the transistors are not source-substrate connected, the Z/L of transistor 42 can be made as small as necessary to provide a $V_{DS}$ of transistor 42 equal to $V_{ON}$ and still provide a large output impedance. In general, the output impedance of this arrangement is defined by the quantity $g_m/g_o^2$, $g_m$ is defined as the small signal transconductance and $g_o$ is defined as the small signal output conductance. Additionally, the output voltage of this arrangement of the present invention can go as low as $2V_{ON}$ above the source of transistors 46 and 50 and still provide an output impedance of approximately $g_m/g_o^2$.

Figure 4:
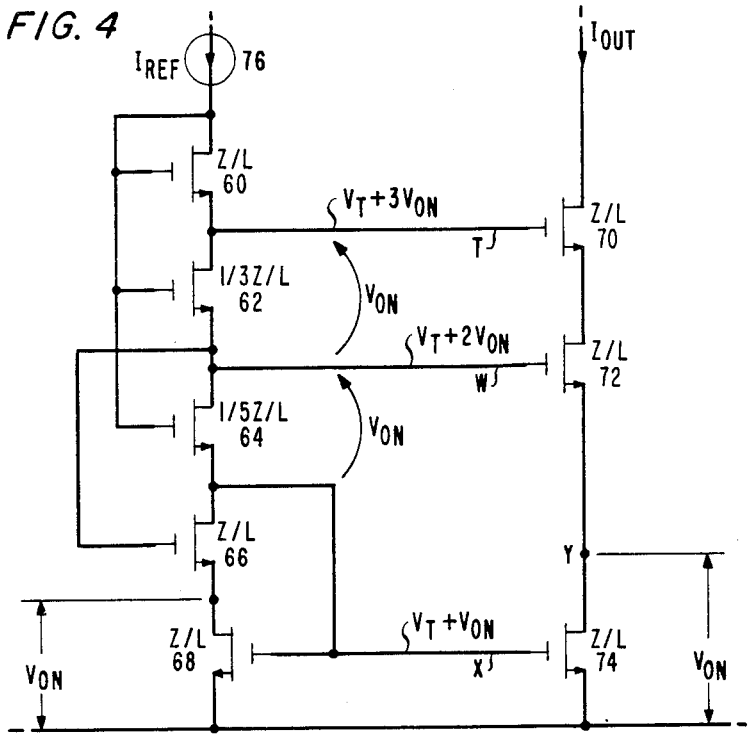
FIG. 4 illustrates an alternative MOS current mirror formed in accordance with the present invention.

An even greater output impedance, on the order of $g_m^2/g_o^3$, at a minimum output voltage of $3V_{ON}$ can be obtained with an alternative circuit arrangement of the present invention, as illustrated in FIG. 4. Similar to the previous embodiment, the current mirror illustrated in FIG. 4 comprises an input circuit branch and an output circuit branch. The input circuit branch includes a series connection of five MOS transistors 60–68, and an input reference current source 76, denoted $I_{REF}$. As seen by reference to FIG. 4, the gate of transistor 60 is connected to its drain, and also to the gates of transistors 62 and 64. The gate of transistor 66 is connected to the source of transistor 62 and similarly, the gate of transistor 68 is connected to the source of transistor 64. The output circuit branch of the current mirror illustrated in FIG. 4 comprises a series connection of three MOS transistors 70–74. As shown, the gate of transistor 70 is connected to the source of transistor 60, where this connection is defined as voltage node T. Also, the gate of transistor 72 is connected to both the source of transistor 62 and the gate of transistor 66, where this connection is defined as voltage node W. Lastly, at a voltage node X, the gate of transistor 74 is connected to both the gate of transistor 68 and the source of transistor 64.

In accordance with the present invention, reference current 76, is coupled to the drain of transistor 60 and is subsequently reproduced as $I_{OUT}$ along the output circuit branch. It is to be noted that transistor 62 comprises a channel constant of $\frac{1}{3}$Z/L and transistor 64 comprises a channel constant of 1/5 Z/L in order to provide the voltages necessary at nodes T, W, and X to provide an output impedance of approximately $g_m^2/g_o^3$.

Applying the same premise as used in association with the description of the previous embodiment of the present invention, the voltage at node T must be equal to $V_T+3V_{ON}$, the voltage at node W equal to $V_T+2V_{ON}$, and the voltage at node X equal to $V_T+V_{ON}$. As before, current mirroring at a high output impedance will be achieved if transistors 68 and 74 comprise indentical characteristics. Here, the voltage at node Y, defined as $V_{DS}$ of transistor 74, will be equal to $V_{ON}$, since a $V_T+V_{ON}$ voltage drop will occur between the gate and source of transistor 72. $V_{DS}$ of transistor 68 is also equal to $V_{ON}$, since a $V_T+V_{ON}$ voltage drop will occur between the gate and source of transistor 66. Since the gates of transistors 68 and 74 are coupled together and connected to the source of transistor 64, and each has the same $V_{DS}$, which is equal to $V_{ON}$, the same current will, by definition, flow through transistors 68 and 74, thus forcing $I_{OUT}$ to be equal to $I_{REF}$.

In order to provide the necessary voltages at nodes T, W, and X, the same process as described above in association with FIG. 3 must be followed. Again, for the purposes of the present discussion it will be assumed that all of the devices are source-substrate connected so that each has the same threshold voltage $V_T$. Providing $V_{DS}$ of transistors 62 and 64 to be equal to $V_{ON}$ is accomplished by operating both transistors in their resistive region, as a result of connecting the gates of transistors 62 and 64 to the gate of transistor 60. To determine the necessary Z/L for transistors 62 and 64, the current flowing through transistors 64, 62, and 60, defined as $I_1$, $I_2$, and $I_3$, respectively, are set equal to each other, where this can be expressed by the following relation $$\mu\frac{C_o}{2}(Z/L)_1[2(V_{GS1}-V_T)V_{DS1}-V_{DS1}^2] = \mu\frac{C_o}{2}(Z/L)_2[2(V_{GS2}-V_T)V_{DS2}-V_{DS2}^2] = \mu\frac{C_o}{2}(Z/L)_3[V_{GS3}-V_T]^2. \quad (8)$$

If $$V_{GS1}-V_T=3V_{ON}, \quad (9)$$

$$V_{GS2}-V_T=2V_{ON}, \text{ and} \quad (10)$$

$$V_{GS3}-V_T=V_{ON}, \quad (11)$$

then as seen by reference to FIG. 4, $$V_{DS1}=V_{GS1}-V_{GS2}=V_{ON}, \text{ and} \quad (12)$$

$$V_{DS2}=V_{GS2}-V_{GS3}=V_{ON}. \quad (13)$$

Substituting equations (9)–(13) into equation (8) and simplifying, $$(Z/L)_1[2(3V_{ON})V_{ON}-V_{ON}^2]=(Z/L)_2[2(2V_{ON})V_{ON}-V_{ON}^2]=(Z/L)_3[V_{ON}]^2. \quad (14)$$

Further simplification yields $$(Z/L)_1[5V_{ON}^2]=(Z/L)_2[3V_{ON}^2]=(Z/L)_3[V_{ON}^2], \text{ or} \quad (15)$$

$$(Z/L)_1=1/5(Z/L)_3, \text{ and} \quad (16)$$

$$(Z/L)_2=\tfrac{1}{3}(Z/L)_3. \quad (17)$$

Therefore, in accordance with the present invention, if transistor 62 comprises a Z/L one-third that of transistor 60, and transistor 64 comprises a Z/L one-fifth that of transistor 60, the voltages $V_T+3V_{ON}$, $V_T+2V_{ON}$, and $V_T+V_{ON}$ can be generated at nodes T, W, and X, respectively, thereby providing on MOS current mirror with an output impedance on the order of $g_m^2/g_o^3$.

What is claimed is:

1. An MOS current mirror including an input circuit branch and an output circuit branch, where the input circuit branch is responsive to a reference current and the output circuit branch mirrors the reference current to produce an output current substantially equal to said reference current, the input branch comprising a series connection of a plurality of four MOS transistors each MOS transistor having a gate, a source, and a drain electrode, where the drain of the first MOS transistor is responsive to said reference current and the gate of said first MOS transistor is connected to both said drain and the gate of the second MOS transistor, the gate of the third MOS transistor is connected to both the source of said first MOS transistor and the drain of said second MOS transistor, and the gate of the fourth MOS transistor is connected to both the source of said second MOS transistor and the drain of the third MOS transistor; and the output branch comprising a pair of MOS transistors each MOS transistor having a gate, a source, and a drain electrode, where the gate of a first MOS transistor of said pair of MOS transistors is connected to the source of said first MOS transistor of said input circuit branch and the gate of the remaining MOS transistor of said pair of MOS transistors is connected to the gate of said fourth MOS transistor of said input circuit branch, wherein each MOS transistor of both said input and said output circuit branches comprises a channel constant defined by its associated channel width divided by its associated channel length, wherein the channel constant of said second MOS transistor of said input circuit branch is at most one-third the value of the channel constant associated with the remaining MOS transistors, where each of the remaining MOS transistors comprises substantially identical channel constant.

2. An MOS current mirror as defined in claim 1 wherein the input circuit branch further comprises an additional MOS transistor connected in series between the second and the third MOS transistors, where the gate of the additional MOS transistor is connected to the gates of the first and second MOS transistors and the channel constant of said additional MOS transistor is at most one-fifth the value of the channel constant associated with the remaining MOS transistors;

and the output circuit branch further comprises an additional MOS transistor connected in series between the pair of MOS transistors, where, the gate of the additional MOS transistor is connected to the source of said additional MOS transistor of said input circuit branch.

3. An MOS current mirror as defined in claims 1 or 2 where each MOS transistor is an N-channel type MOS transistor.

4. An MOS current mirror as defined in claims 1 or 2 where each MOS transistor is a P-channel type MOS transistor.

5. An MOS current mirror circuit comprising an input circuit branch and an output circuit branch wherein the input circuit branch is responsive to a reference current and the output branch mirrors the reference current to produce an output current substantially equal to said reference current, each circuit branch comprising a plurality of source-substrate connected MOS transistors wherein each MOS transistor exhibits a substantially identical threshold voltage, $V_T$, said input and output circuit branches interconnected such that a first interconnection will exhibit a voltage approximately equal to the quantity $V_T+2V_{ON}$, a second interconnection will exhibit a voltage approximately equal to the quantity $V_T+V_{ON}$, and a third interconnection between the input circuit branch and the output circuit branch will exhibit a voltage approximately equal to the quantity $V_T+3V_{ON}$.

* * * * *